United States Patent [19]

Haig

[11] 4,450,981

[45] May 29, 1984

[54] PRECISION MATERIAL FILLING SYSTEMS

[75] Inventor: David E. Haig, Erdenheim, Pa.

[73] Assignee: Abe Jacobs, Philadelphia, Pa.

[21] Appl. No.: 293,891

[22] PCT Filed: Feb. 22, 1979

[86] PCT No.: PCT/US79/00098

§ 371 Date: Feb. 26, 1979

§ 102(e) Date: Feb. 26, 1979

[87] PCT Pub. No.: WO80/01797

PCT Pub. Date: Sep. 4, 1980

[51] Int. Cl.[3] ..... B67D 5/08

[52] U.S. Cl. ..... 222/61; 222/64; 222/639; 137/209

[58] Field of Search ..... 141/94; 222/23, 30, 222/36, 55, 56, 57, 61, 62, 64, 399, 504, 14, 70, 640, 641, 644, 639; 137/209, 213, 214

[56] References Cited

U.S. PATENT DOCUMENTS

| | | | |
|---|---|---|---|
| 2,660,336 | 11/1953 | Coffey et al. | 222/644 |
| 3,394,847 | 7/1968 | Garrard | 222/399 |
| 3,499,580 | 3/1970 | Smith | 222/61 |
| 3,612,090 | 10/1971 | Kassel | 137/209 |
| 3,976,222 | 8/1976 | Spagnolo | 222/641 |
| 4,090,526 | 5/1978 | Witt et al. | 137/209 |

*Primary Examiner*—H. Grant Skaggs
*Attorney, Agent, or Firm*—Walter B. Udell

[57] ABSTRACT

The filling systems according to the invention utilize pneumatic pressure maintained within closely held tolerance limits to impose a constant dispensing force upon the material being dispensed. The invention in one embodiment utilizes a buffer tank system in which the product to be dispensed is transferred from a supply tank (11) to the buffer tank (12) where the desired pressure is induced through a pneumatic head which is introduced above the product level. The product level in the buffer tank (12) is allowed to fluctuate within a relatively narrow band of depth so as to negate the effect of changes in gravity head pressure. The closed and pressurized system is refilled by forcing the incoming product into the tank (12) under a higher pressure than that in the buffer tank (12). The air within the tank (12) that is displaced as a result of introducing the new product is automatically vented to atmosphere through a precision regulation system (45).

The pressure balancing system incorporates either a piston or diaphragm balancing member controller device (81) which controls a three-way pneumatic valve (72) for charging or venting the dispensing tank (58). The desired product set point pressure is applied to one side of the balancing member (80) and the actual product pressure is applied to the other side. As the level in the tank (58) drops, the gravity head pressure drops, and this is sensed at the bottom of the tank. The balancing member (80) favors the side with the lower pressure causing the three-way valve (72) to open and pneumatically charge the tank (58) until the set point pressure and the actual product pressure are equal. If the actual product pressure becomes greater than the set point pressure (72) to exhaust the excess pressure to atmosphere. The response time and sensitivity of the system are adjusted by a flow control valve (68) in the charging circuit, and by increasing or decreasing the pressure differential between the charging pressure and the set point pressure.

28 Claims, 6 Drawing Figures

FIG. 1
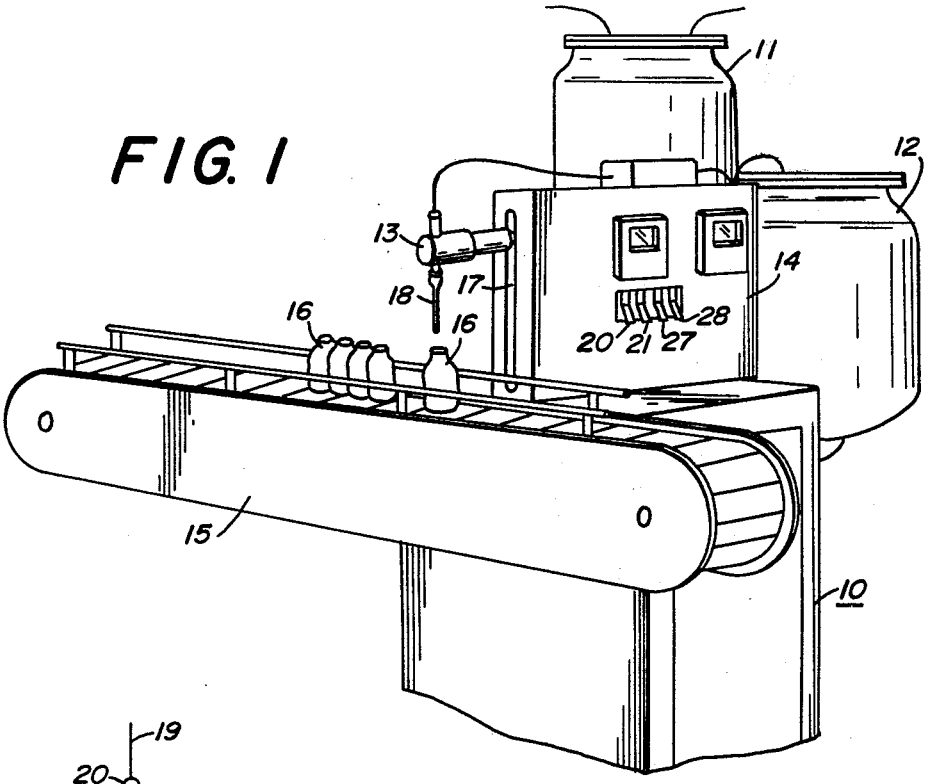
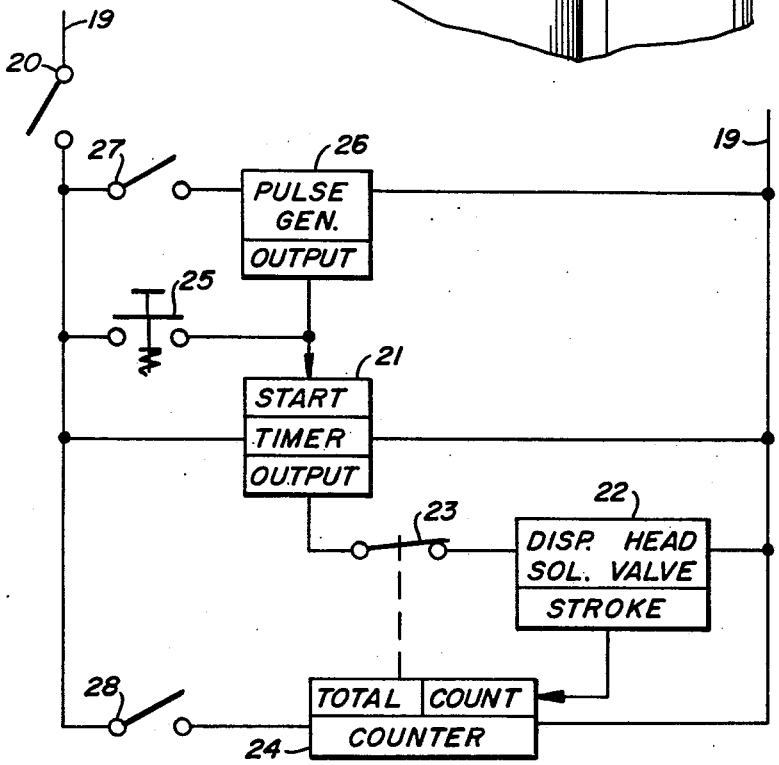
FIG. 2

PRECISION MATERIAL FILLING SYSTEMS

TECHNICAL FIELD

This invention relates generally to material filling systems, and more particularly relates to precision filling systems capable of filling containers within tolerance limits of ±0.1% to ±0.5%. The system is applicable for the precise dispensing of fluid materials through a wide range of viscosity including creams, but is also usable for the dispensing of powdered and particulate materials.

BACKGROUND ART

Filling accuracies in various packaging fields have been expected only within the range of 2% to 5%, and in such cases it has been necessary to overfill the package or container in order not to be underfilled within the filling tolerance limits. Particularly in the pharmaceutical field, with some substances costing on the order of $50.00 to $100.00 per ounce, the savings in product cost achievable with equipment capable of accuracies within the 0.1% to 0.5% range is very high and can effect such cost savings as to pay for the equipment according to the invention within extremely short times, sometimes within a matter of weeks.

Presently used filling systems use pumping devices such as piston pumps or rotary pumps, both of which have moving parts which cause abrasion and the generation of fine particles which can and do enter into the product being dispensed, thereby causing particulate contamination. The system according to the invention has no moving parts during the dispensing process and is free of particulate contamination.

Further, in the pharmaceutical field, sterilization is sometimes extremely important, and pharmaceutical companies when running some products operate a third eight hour shift each day solely to dismantle, autoclave the system parts, and reassemble the system. Even with such sterilization techniques there is the continuing possibility of recontamination of the equipment due to handling in reassembly. The system according to the invention is sterilizable without disassembly and in a small fraction of the time required by the present day conventional sterilization techniques for such systems.

Finally, the pumping fill systems presently used create two additional problems when dispensing certain types of materials. One problem is foaming which can take place because the materials are not handled in a gentle fashion due to the high peak pressures developed by pumping type dispensing systems. The second problem is that of molecular shear which causes damage to protein substances, and which occurs in conventional piston type filling equipment as a result of the piston walls being wiped by the piston seals as the substance flows through the pump.

DISCLOSURE OF INVENTION

The filling systems according to the invention utilize pneumatic pressure maintained within closely held tolerance limits to impose a constant dispensing force upon the material being dispensed, thereby avoiding foaming by providing a lower average and constant flow rate to the substance being dispensed. Additionally, since the material being dispensed is not in contact with moving parts during the dispensing operation, there is no abrasion and particulate contamination, nor is there molecular shearing damage to the products being dispensed.

Also inherent in the system is the ability to steam or gas sterilize the entire system without dismantling any part of it by introducing steam or gas at various points in the system and allowing it to flow through the system out through the dispensing head. The invention in one embodiment utilizes a buffer tank system, and in a second embodiment utilizes a pressure balancing system.

The buffer tank system minimizes the effect of high gravity head pressure found in conventional deep supply tanks. Such gravity head pressure reduces as the level in the tank drops, and can significantly change the amount of product passing through the dispensing head if not compensated for. In order to minimize this effect so as to maintain an acceptable accuracy tolerance, the product to be dispensed is transferred from the supply tank to the buffer tank where the desired pressure is induced through a pneumatic head which is introduced above the product level. The product level in the buffer tank is then allowed to fluctuate within a relatively narrow band of depth so as to negate the effect of changes in gravity head pressure to a point sufficient for high accuracy filling. It is possible to refill this closed and pressurized system by forcing the incoming product into the tank under a higher pressure than that of the buffer tank. The air within the tank that is displaced as a result of introducing the new product is automatically vented to atmosphere through a precision regulation system which has a high reverse flow capability to any pressure generated in excess of the set buffer tank pressure.

The embodiment of the invention employing the pressure balancing system especially lends itself to high volume filling operations where a single large bulk supply tank can be used to feed directly to the dispensing heads. This system incorporates either a piston or diaphram balancing member sensing device which controls a three way pneumatic valve for charging or venting the dispensing tank. The desired product set point pressure is applied to one side of the balancing member and the actual product pressure is applied to the other side. As the level in the tank drops, the gravity head pressure drops, and this is sensed at the bottom of the tank. Since the balancing member favors the side with the lower pressure, the three-way valve opens and pneumatically charges the tank until the set point pressure and the actual product pressure are equal. If the actual product pressure were to become greater than the set point pressure, the balancing member would actuate the three-way valve to exhaust the excess pressure to atmosphere. The response time and sensitivity of the system are adjusted by a flow control valve in the charging circuit, and by increasing or decreasing the pressure differential between the charging pressure and the set point pressure.

A primary object of the invention is to provide a precision material filling system capable of dispensing the product with accuracies on the order of one tenth to one half percent.

Other objects of the invention are to provide novel precision material filling systems as aforesaid which eliminate particulate contamination of the product being dispensed, which avoid molecular shear in the product being dispensed, which eliminate foaming in dispensing products having a tendency to foam, and which are sterilizable without dismantling and in a relatively short time interval.

BRIEF DESCRIPTION OF DRAWINGS

FIG. 1 is a representational view of a system according to the invention showing a conveyor carrying containers to be filled, a dispensing head, control system and product storage tanks;

FIG. 2 is a schematic diagram of a control system for actuating the dispensing system for filling containers under the dispensing nozzle;

BEST MODE FOR CARRYING OUT THE INVENTION

Figure 3:
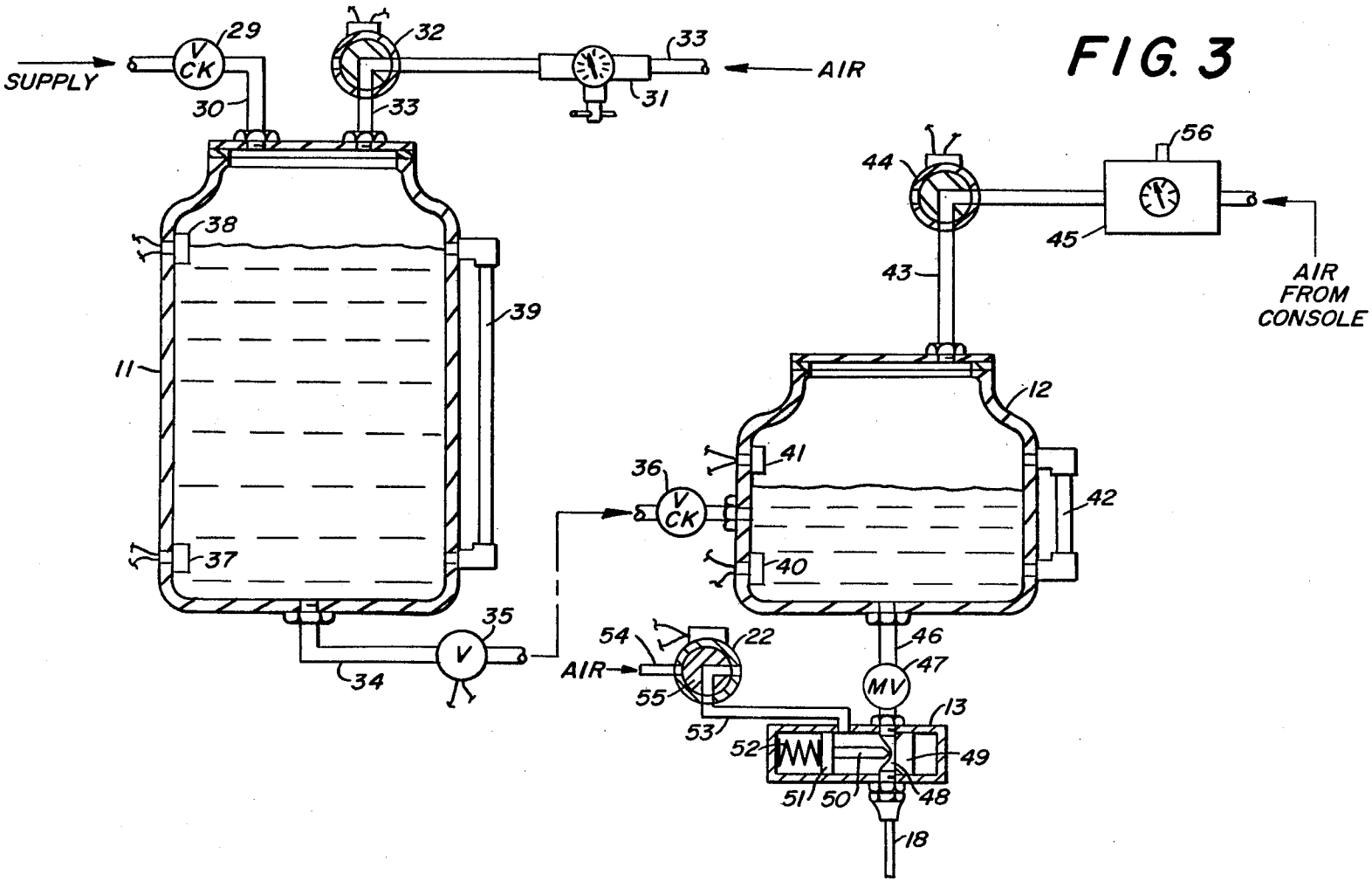
FIG. 3 is a schematic and diagrammatic representation illustrating the buffer tank system embodiment of the invention.

Referring first to FIG. 1, there is seen a precision material filling apparatus of the buffer tank type designated generally as 10. The apparatus consists of a storage tank 11, buffer tank 12, dispensing head 13, control console 14, and a conveyor 15 carrying containers 16 to be filled. In operation, the containers 16 are moved along the conveyor 15 and stop under the dispensing head 13. The movements of the conveyor 15 are synchronized with the actuation of the dispensing head 13 to insure that material flow through the dispensing head only occurs when a container is thereunder. The synchronization system for effecting this timing sequence does not constitute a part of the invention and is generally well known in the art.

As each container is positioned under the dispensing head 13, the conveyor 15 stops, the dispensing head 13 moves physically downward in the slot 17 until the dispensing nozzle 18 enters the neck of the container 16. The controls of the console 14 are either manually actuated or automatically actuated for a predetermined time interval to dispense the predetermined required quantity of material into the container 16, after which, the dispensing head 13 terminates the flow of material and the head is raised to clear the nozzle 18 from the container 16. The container 16 then moves outward from under the dispensing head, and the next container is moved by the conveyor 15 into position to be filled. The control system for carrying out the sequence, except for the dispensing head movement and conveyor control, is illustrated in FIG. 2, to which attention should now be directed.

Electrical power is supplied to the circuitry from any suitable source via the conductor pair 19 through on-off power switch 20. Closure of the power switch 20 energizes the timer 21 which controls the actuation of the dispensing head 13 through a solenoid valve 22 contained within the dispensing head. The controlled output of the timer 21 acts through a normally closed switch 23 which is part of and actuated by a counter 24 under certain circumstances. When the counter is not being utilized, the switch 23 is normally closed, and the dispensing head solenoid 22 is entirely controlled by the timer 21. For manual operation, a momentary-make manually operable switch 25 is utilized.

Assuming that a container 16 has been properly positioned to receive material from the dispensing head 13, depression and release of the manual switch 25 pulses the timer 21 and starts the timing cycle which will have been preset in accordance with a desired time interval suitable for depositing the desired quantity of material into the container 16. Once the timer 21 has been started by the switch 25, the switch 25 has no further control over the time cycle and the timer energizes the dispensing head solenoid 22 in a suitable fashion to open the dispensing head for flow of material therethrough. The solenoid 22 remains energized for the predetermined length of time set into the timer 21, and when the timer times out, it automatically deenergizes the dispensing head solenoid 22 thereby causing the solenoid to shut off the flow of material through the dispensing head 13.

The manual operation is of course utilizable for any selected number of cycles, but must be actuated once for each desired dispensing cycle. The timing cycle of the timer 21 will normally lie within the range of 1 to 4 seconds, but the timer may have a much higher timing capacity, on the order of 99 seconds for a suitable digital device. Digital timers of any desired accuracy are of course available, and timing precisions of any desired accuracy are available. For most applications timing precisions of one tenth of a second will be suitable, but precisions to hundredths of a second may in some cases be necessary or desirable.

For automatic sequential multiple continuous filling cycles a pulse generator 26 is provided, and is actuatable by an energizing control switch 27. The pulse generator is adjustable to produce pulse rates of one to one hundred pulses per minute, and will be set to produce for each filling cycle required. For example, if a complete filling cycle requires six seconds to position a container, fill it and move the next container into position, then the pulse generator 26 will produce a pulse each six seconds or at a rate of ten pulses per minute. The timing of the pulse is of course synchronized with the movement of the conveyor 15 so that the dispensing head is activated to dispense material at the correct time in the overall cycle. Each time the generator generates a pulse, the pulse is routed to the start circuit of the timer 21 and actuates the dispensing head solenoid 22 in accordance with the time interval set into the timer 21. This cyclic operation will continue indefinitely until terminated either manually by opening switch 27, or automatically under control of the counter 24.

Each time the dispensing head solenoid 22 is actuated, a signal is sent to the count input of the counter 24. If the counter 24 is deenergized, the count signals are ineffective. However, if the counter 24 is energized by closure of control switch 29, each count signal from the dispensing head solenoid 22 registers a count into the counter. When the count signals received by the counter reach a predetermined total set into the counter 24, the counter automatically opens switch 23 and thereby prevents the timer 21 from further actuating the dispensing head solenoid 22 irrespective of whether or not it is receiving start signals from the manual switch 25 or the pulse generator 26. The counter 24 is employed in those situations where only a certain number of fill operations are desired and it is desired to have this carried out without human monitoring. If desired, actuation of the switch 23 by the counter can also be utilized to terminate further movement of the conveyor 15.

Understanding now the general operation of the filling system, attention should be directed to the showing of FIG. 3 which illustrates the buffer tank embodiment of the invention. The storage tank 11 is fed from a source of supply to a top inlet through a check valve 29 and inlet line 30, and is also supplied from a pressurizing source of cleaned and sterilized air to a head space top inlet through an air regulator 31, solenoid valve 32 and inlet air line 33. The tank 11 has a bottom outlet transfer line 34 which feeds buffer tank 12 through a solenoid actuated valve 35 and a check valve 36. Storage tank 11 is also fitted with a lower product level sensing switch 37, an upper product level sensing switch 38 and a sight glass 39.

Similarly, buffer tank 12 is fitted with lower and upper level sensing switches 40 and 41 and a sight glass 42. The head space above the product level in the buffer tank 12 is pressurized with cleaned and sterilized air from the air supply through the top inlet line 43, the pressure venting valve 44 and a precision pressure regulator 45. The product outflow from the buffer tank 12 takes place through the bottom outlet line 46 through a manual valve 47 which feeds the dispensing head 13 and ultimately the dispensing nozzle 18.

The dispensing head 13 is shown in a closed position so that there is no flow through the dispensing nozzle 18. Within the dispensing head 13 extending from top to bottom in the flow path is a replaceable section of flexible plastic tubing 48 which is shown pinched closed between an anvil 49 and the plunger 50 of a piston 51, which latter is urged into the flow closing position by a compression spring 52. The flexible tubing 48 may be made of silicone rubber to withstand the elevated temperatures of steam sterilization. The housing of the dispensing head 13 in the region containing the piston plunger 50 is connected through an air line 53 to the three way solenoid valve 22, the valve being shown in the exhaust position so that the piston plunger chamber is vented to atmosphere and allowing the spring 52 to drive the piston to the right to shut off the flow of product through the plastic tubing 48. The solenoid valve 22 is also connected via air line 54 to a source of pressurized air so that when the solenoid 22 is energized to rotate the solenoid rotor 55 ninety degrees counterclockwise, the air line 54 is connected to the air line 53 which pressurizes the piston plunger chamber and drives the piston 51 to the left against the pressure of spring 52 and releases the closing pinch on plastic tubing 48 thus permitting flow from the buffer tank 12 through the dispensing head.

Assuming that the system is empty and that it is desired to start the system up, the conditions are as follows. The product comes from the supply source under a pressure which is lower than the air pressure at the supply tank inlet air line 33 as determined by the air pressure regulator 31. Additionally, the pressure in the supply tank 11, at whatever level the product exists in the tank 11 is a higher pressure than the pressure maintained in the buffer tank 12 by air flowing into the buffer tank through the buffer tank top inlet line 43 and the precision pressure regulator 45. The level sensing switches 37 and 38 of the supply tank 11 control the actuation of solenoid valve 32, and the level sensing switches 40 and 41 control the actuation of solenoid valve 35.

When the level of the product in the supply tank 11 falls to the level of sensing switch 37, switch 37 causes solenoid valve 32 to rotate ninety degrees clockwise and vent the head space of the storage tank 11 to atmosphere and block the supply of pressurized air from the regulator 31. Accordingly, with the pressure in the supply tank decreased below the pressure of the product supply source, the supply source feeds product through check valve 29 and supply inlet line 30 into the storage tank 11. At the same time, since there is no product supply in buffer tank 12, the lower level sensing switch 40 actuates solenoid valve 35 to open the transfer line 34 so that product flowing into tank 11 may be moved through line 34 and into the buffer tank 12.

The filling procedure continues until two things occur, with the order of occurrence being dictated by the relative level positionings of the storage and buffer tanks with respect to one another. If the product level in the buffer tank 12 reaches upper level sensing switch 41 before the product level in storage tank 11 reaches upper level sensing switch 38, then the level sensing switch 41 will actuate the solenoid valve 35 and terminate the flow of product into the buffer tank 12 while the storage tank will continue to fill until the upper level sensing switch 38 senses the product level and actuates solenoid valve 32 to rotate the valve rotor ninety degrees counterclockwise and connect the storage tank head space to the source of regulated pressurized air flowing through regulator 31. Since the pressurized air is at a higher pressure than that of the supply source, the storage tank head space becomes pressurized above the pressure of the supply source and check valve 29 terminates the flow of further product into the storage tank 11.

Even though pressurized air was present in the buffer tank 12 at all times through the precision pressure regulator 45, the higher product pressure from the storage tank caused the pressurized air in the head space to backflow through the buffer tank inlet line 43 and automatically vent through the back pressure vent 56 of the precision regulator 45. When the upper level sensing switch 41 of the buffer tank 12 closed solenoid valve 35, the back venting terminated. Under the conditions as stated, the system is filled and is static and ready for operation.

In operation, dispensing from the buffer tank 12 takes place through the dispensing head 13 by actuation of the solenoid valve 22 under control of the timer as previously described in connection with the showing of FIG. 2. As the level in the buffer tank 12 drops, a constant head space pressure is maintained in the buffer tank 12 by the precision pressure regulator 45. When the product level in the buffer tank 12 drops to the level of the lower level sensing switch 40, the sensing switch 40 opens solenoid valve 35 so that product form the storage tank 11 flows through transfer line 34 under pressure of product gravity and head space air pressure in the tank 11 and into buffer tank 12. The flow of product into the tank 12 forces head space air in the buffer tank again back through air inlet line 43 and out through the back pressure vent 56 of the precision pressure regulator 45 until the product level reaches upper level sensing switch 41, which upon actuation closes solenoid valve 35 to complete the product transfer from storage tank 11 to buffer tank 12.

The transfer of product from storage tank 11 to buffer tank 12 may be carried out even while dispensing through the dispensing head 13 is going on without any change in the precision of fill dispensed through the dispensing head 13. This result is achievable through the fine control of head space pressure in the buffer tank 12 accomplished with the precision pressure regulator 54, and the fact that the variation in product head within the tank between the level sensing switches 40 and 41 allows for a product head variation only on the order of one foot. In less critical applications, a greater head differential may be tolerable in the buffer tank 12. The variation in product pressure at the bottom outlet due to variation in product head within the buffer tank is insignificant because the product head pressure is very small compared to the constantly maintained pneumatic head space pressure, being on the order of one percent (1%). In the manner previously described, automatic refilling of the storage tank 11 from the product supply source is effected through the level sensing switches 37 and 38 and solenoid valve 32, and this automatic supply tank refilling operation can proceed whether or not a transfer of product from the storage tank to the buffer tank is in process.

Figures 4, 4A, 4B:
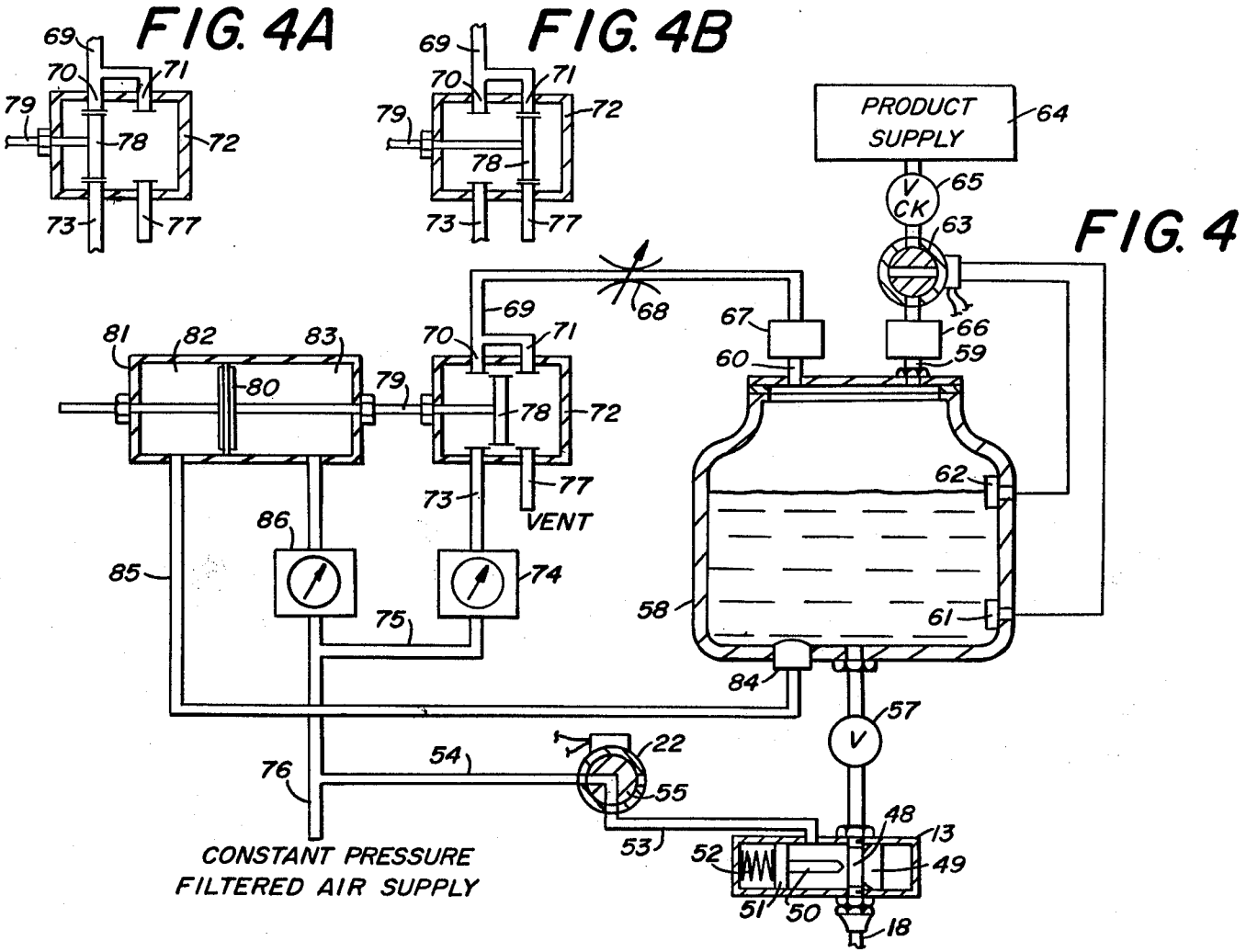
FIGS. 4, 4A and 4B are diagrammatic and schematic representations of the pressure balancing system embodiment of the invention.

The embodiment of FIG. 4 makes possible the elimination of the two tank system of FIG. 3 and permits the use of a single large dispensing supply tank because variations of product pressure at the dispensing head are eliminated irrespective of the level of product within the tank. This is achieved by a novel system in which the product pressure at the bottom of the tank is maintained constant irrespective of the product level. This is effected through a novel control system which is illustrated in the showing of FIG. 4 to which attention should be now directed.

The dispensing head 13 is fed through a valve 57 from a large dispensing tank 58 which latter is provided at its top with a product inlet line 59 and a pressurizing air inlet line 60. The tank 58 is also provided with lower and upper level sensing switches 61 and 62 which control the actuation of solenoid valve 63 so that additional product from the supply 64 may, when required, flow through check valve 65 and opened solenoid valve 63 and a sub-micron biological type filter 66 through the product inlet line 59 into the tank 58. The tank 58 may be a large tank on the order of twenty feet in height and holding perhaps two thousand gallons of product. Tanks of this size can develop large head differentials which could result in pressure differences on the order of nine PSI from maximum to minimum fill with aquaeous solutions.

The pressurizing air for tank 58 supplied through inlet line 60 reaches the tank 58 through a sub-micron biological type filter 67, a volumetric flow control 68 and an air feed line 69 which connects to two ports 70 and 71 of a three-way pneumatic valve 72. The valve port 70 is a charging port through which the tank 58 is charged with pressurized air from air line 73 fed by pressure regulator 74 from a constant pressure filtered and sterilized air supply via air lines 75 and 76. The tank 58 is vented of over-pressure through venting port 71 and vent line 77 of the pneumatic valve 72 when the valve is appropriately positioned to effect that end.

In the diagrammatic showing of FIG. 4A, the pneumatic valve 72 is illustrated as having the charging port 70 and inlet pressurized air line 73 connected within the valve by shiftable conduit section 78, while in the showing of FIG. 4B, the venting port 71 and vent line 77 are shown so interconnected by the shiftable conduit section 78 during a tank venting operation. FIG. 4 illustrates the conduit section 78 in a position intermediate the charging and venting ports and representing a condition where the pressurization in the tank 58 is exactly at the desired set point so that neither charging nor venting is desired.

The shiftable conduit section 78 of the pneumatic valve 72 is positionally controlled by means of a control rod 79 which is coupled to a piston 80 disposed within a pressure differential sensing controller device 81. The controller device 81 could be a diaphram type instead of a piston or cylinder type if considered desirable. The piston 80 divides the controller device 81 into two interior chambers 82 and 83, the chamber 82 being a product pressure sensing chamber which is connected to a product pressure sensing device 84 at the bottom of the dispensing tank 58 by a product pressure transmitter 85, whereas the chamber 83 is a reference pressure chamber which receives pressurized air from the constant pressure air supply through pressure regulator 86. The pressure sensor 84 and pressure transmitter 85 provide a one-to-one transmission of pressure to the controller 81 from the tank 58 while isolating the product from the controller 81.

The reference pressure in chamber 83 is set at the pressure which it is desired to have at the bottom of dispensing tank 58, so that this pressure is that which is presented to the dispensing head 13. The charging pressure regulator 74 is set at a pressure typically, but not necessarily, five PSI higher than the reference pressure in chamber 83, as determined by the reference pressure regulator 86. The product supply 64 is also pressurized at a pressure slightly higher than the charging pressure as set by regulator 74. The product supply 64 may be pressurized in any convenient manner, but generally would be pressurized from the same source of constant pressure sterilized and filtered air as is used to pressurize the rest of the system. The dispensing head 13 and solenoid 22 are connected into the system in exactly the same manner as has already been described in connection with the showing of FIG. 3, although in the showing of FIG. 4, the piston 51 is shown in retracted position so that the flexible plastic tubing 48 is open for flow therethrough.

Assuming that the system were initially empty and is to be filled, lower level sensing switch 61 will cause solenoid valve 63 to rotate ninety degrees and connect the product supply 64 to the tank 58 so that the product begins to flow from the supply into the tank, and continues to so flow until the product reaches the level of the upper level sensing switch 62 which latter then actuates the solenoid valve 63 to cause it to again rotate ninety degrees and terminate the flow of the product from the supply 64. As the head of product builds in the dispensing tank 58, the pressure of the product at the bottom of the tank is communicated to product pressure sensing chamber 82 of the differential sensing controller device 81. Since the reference pressure 86 will have previously been set, reference pressure chamber 83 will be pressurized at the reference pressure.

Since the reference pressure in chamber 83 is always selected to be higher than the gravity head pressure of the product in tank 58, the piston 80 will be displaced toward the left thereby carrying control rod 79 and shiftable conduit section 78 of the pneumatic valve 72 also to the left to the position shown in FIG. 4A. With charging port 70 thus connected to air line 73, charging pressure is applied through air feed line 69, volumetric flow control 68 and submicron biological filter 67 to the head space above the product in dispensing tank 58. As the head pressure builds up in tank 58, the pressure at the bottom of tank 58 increases and is transmitted to the product pressure sensing chamber 82. As the pressure differential between chambers 82 and 83 diminishes, the piston 80 in the controller device 81 starts to move toward the right until, when the chamber pressures are equal, the conduit section 78 is just moved into a position to disconnect the charging port 70 from the charging air line 73. Thus, the system is in balance with the dispensing tank pressure at the tank bottom equal to the reference pressure established by pressure regulator 86.

As dispensing takes place from the tank 58 and the product gravity head pressure starts to diminish, this diminution of pressure occurs at the tank bottom and is communicated to product pressure sensing chamber 82, thereby causing the balancing piston 80 to begin to shift to the left due to the pressure differential between the chambers 82 and 83. As the balancing piston 80 starts to shift to the left it again brings the shiftable conduit section 78 of the pneumatic valve 72 into a position where communication is established to some degree between the charging port 70 and the charging air line 73 so that additional charging pressure is communicated through the air feed line 69 to the head space of tank 58 thereby increasing the head space pressure and consequently increasing the pressure at the bottom of the tank. The increased pressure at the bottom of tank 58 is communicated to chamber 82 which tends to restore the balance of balancing piston 80 by shifting it over toward the right and again disconnecting the charging port 70 from the air line 73.

There is thus established a hydraulic/pneumatic servo loop capable of maintaining a very fine control of the product pressure at the bottom of the dispensing tank 58 irrespective of the level of the product within the tank. As the product level withinn the tank falls, the loss of product head pressure is made up by increased head space pressure from the pressurized air source.

When the product level within tank 58 falls to the point where it actuates level sensing switch 61, solenoid valve 63 is again actuated to connect the product supply 64 to the tank 58 and begin the refilling of the dispensing tank 58 up toward the level determined by the location of the upper level sensing switch 62. Since the product from the product supply 64 is under higher pressure than the charging pressure out of pressure regulator 74 it is enabled to flow into the tank 58. Accordingly, the pressure at the bottom of the tank 58 begins to increase above the desired set pressure as determined by pressure regulator 86. This increasing pressure is communicated to product pressure sensing chamber 82 which thus establishes a differential pressure with the reference pressure in chamber 83 such as to cause the balancing piston 80 to begin to move to the right and carry the shiftable conduit section 78 of the pneumatic valve 72 toward the position shown in FIG. 4B in which it connects the venting port 71 to the vent line 77.

As the venting circuit is established, the pressurized air in the head space of the tank 58 flows backward through filter 67, volumetric flow control 68 and pneumatic valve 72 to vent the excess pressure to the atmosphere. The venting of the tank 58 continues until the refilling of the tank with product has been completed, at which point the product supply 64 is again disconnected from the tank 58 by actuation of the solenoid valve 63 due to the action of the upper level sensing switch 62. The pressure at the bottom of tank 58 being again at the proper point, the balancing piston 80 has gradually moved to the left to terminate the venting of the tank so that the pneumatic valve 72 is as shown in FIG. 4.

In actuality, the small pressure variations at the bottom of the tank 58 are communicated on a continuous basis to chamber 82 of the controller device 81 so that the pneumatic valve 72 is constantly in the process of moving between the valve closed position and either the charging position or the venting position, so that a very fine control is exercised over the product pressure at the bottom of dispensing tank 58. As in the case of the buffer tank system described in the showing of FIG. 3, the system of FIG. 4 operates continuously to dispense product through the dispensing head 13 irrespective of whether or not product is being fed from the product supply 64 into the dispensing tank 58. As previously pointed out, the response time and sensitivity of the system are adjusted by the flow control valve 68 and by increasing or decreasing the pressure differential between the charging pressure regulator 74 and the set point pressure regulator 86.

Also, while not shown in the buffer tank system of FIG. 3, filters of the type shown at 66 and 67 in FIG. 4 can be utilized in the buffer tank system if desired. They would be placed in inlet air line 43 and in the product transfer line 34 between the check valve 36 and the buffer tank 12. If further filtering were desired, such filters could also be placed in product supply line 30 between check valve 29 and tank 11, and in air inlet line 33 between solenoid valve 32 and tank 11.

The precision pressure regulators 45, 74 and 86 could typically be servo balanced Model 10B Bellofram regulators made by Bellofram Corp. of Burlington, Mass.; the volumetric flow control 68 could typically be a Super Vee flow control valve Model FCB-14 made by Falco-Air Co. of Gainesville, Fla.; the sub-micron biological type filters 66 and 67 could typically be Type ST-1 filters made by Millipore Corp. of Bedford, Mass.; the three way pneumatic valve 72 and pressure differential sensing controller device 81 could be a Moore Nullmatic Process controller Model 55M made by Moore Products Co. of Springhouse, Pa., utilized with a Moore Type 19L1 sensor diaphragm and a Moore Type 62V constant differential relay corresponding to product pressure sensor 84 and product pressure transmitter 85.

Having now described my invention in connection with particularly illustrated embodiments thereof, it will be apparent that variations and modifications of the invention may now occur from time to time to those normally skilled in the art without departing from the essential scope or spirit of the invention, and accordingly it is intended to claim the same broadly as well as specifically as indicated by the appended claims.

I claim:

1. A precision material filling system characterized by, (a) a dispensing tank containing a flowable dispensable product, (b) dispensing means associated with the dispensing tank for dispensing product from said tank, said dispensing means comprising, (1) an actuatable product dispenser actuatable in a first way to permit flow of product therethrough for dispensing, and actuatable in a second way to terminate flow of product therethrough, (2) actuatable timer means operatively coupled to said actuatable product dispenser and effective each time actuated to actuate said product dispenser in said first way and after a predetermined time interval to automatically actuate said product dispenser in said second way, said timer means including means for selectively setting said predetermined time interval, (3) control means for actuating said timer means, and (c) pressurizing means operatively coupled to said dispensing tank effective for pneumatically pressurizing the product in said tank, said pressurizing means being effective to maintain the product pressure at said dispensing means substantially constant irrespective of the product quantity in said dispensing tank.

2. A precision material filling system as set forth in claim 1 wherein said pressurizing means comprises, (a) pressure monitoring means effective to monitor the pressure at a selected level in said tank, (b) pressure transfer means for coupling a source of a gaseous pressurizing medium to said tank, (c) control means operatively associated with said pressure transfer means and said pressure monitoring means, said control means being effective to cause the transfer of pressurizing medium to said tank when said pressure monitoring means senses a pressure less than a predetermined reference pressure, and being effective to cause the venting of pressurizing medium from said tank when said pressure monitoring means senses a pressure greater than the aforesaid predetermined reference pressure.

3. A precision material filling system characterized by, (a) a dispensable product dispensing tank, (b) dispensing means associated with the dispensing tank for dispensing product from said tank, (c) a pressurized supply source of flowable dispensable product, (d) transfer means including actuatable product flow control means connecting said supply source to said dispensing tank through which said product is transferrable from said supply source to said dispensing tank, (e) product quantity sensing means associated with said dispensing tank and operatively coupled to said product flow control means, said sensing means being effective to sense the occurrence of a predetermined minimum and predetermined maximum quantity of product in said dispensing tank and being operative to actuate said product flow control means in a first way to permit product to flow from said supply source into said dispensing tank when said predetermined minimum quantity of product is sensed, and being operative to actuate said product flow control means in a second way to terminate the flow of product from said supply source to said dispensing tank when said predetermined maximum quantity of product is sensed, (f) pressurizing means operatively coupled to said dispensing tank effective for pressurizing the product in said dispensing tank, said pressurizing means being effective to maintain the product pressure at said dispensing means substantially constant irrespective of the product quantity in said dispensing tank.

4. A precision material filling system as set forth in claim 3 further including a filter in said product transfer means on the downstream side of said product flow control means, said filter being effective to prevent the passage of fine particles and biological organisms.

5. A precision material filling system as set forth in claims 1, 3, or 4 wherein said pressurizing means pneumatically pressurizes the interior of said dispensing tank at a level above the product level in said tank.

6. A precision material filling system as set forth in claims 1, 3 or 4 wherein said pressurizing means comprises transfer means including pneumatic flow control means connecting a source of pneumatic pressure to said dispensing tank.

7. A precision material filling system as set forth in claim 6 further including a filter in said transfer means of said pressurizing means between said pneumatic flow control means and said dispensing tank.

8. A precision material filling system as set forth in claim 6 wherein said pneumatic flow control means is bi-directional.

9. A precision material filling system as set forth in claim 6 wherein said pressurizing means pneumatically pressurizes the interior of said dispensing tank at a level above the product level in said tank.

10. A precision material filling system as set forth in claim 1 or 3 wherein said dispensing means comprises, (a) an actuatable product dispenser actuatable in a first way to permit flow of product therethrough for dispensing, and actuatable in a second way to terminate flow of product therethrough, (b) actuatable timer means operatively coupled to said actuatable product dispenser and effective each time actuated to actuate said product dispenser in said first way and after a predetermined time interval to automatically actuate said product dispenser in said second way, said timer means including means for selectively setting said predetermined time interval, and (c) control means for actuating said timer means.

11. A precision material filling system as set forth in claim 3 wherein the pressure on the product in said pressurized dispensable product supply source is higher than the pressure exerted by said pressurizing means on the product in said dispensing tank.

12. A precision material filling system as set forth in claim 3 wherein the gravity head pressure differential of the product in said dispensing tank between the said predetermined maximum and minimum product quantities in said tank is very small by comparison with the pressure exerted on the product in said dispensing tank by said pressurizing means.

13. A precision material filling system as set forth in claim 2 wherein said control means comprises, (a) pressure differential sensing controlling means, (b) valve means actuatable by said pressure differential sensing controller means for pressurizing said tank by connecting said tank through said pressure transfer means to said source of pressurizing medium, actuatable for venting said tank, and actuatable for blocking said pressure transfer means to neither pressurize nor vent said tank, and (c) reference pressure setting means operatively coupling a reference pressure to said pressure differential sensing controller means derived from the source of pressurizing medium, said pressure monitoring means also coupling the pressure monitored at said tank to said pressure differential sensing controller means, whereby, when said reference pressure exceeds said tank pressure said controller actuates said valve means to pressurize said tank, when said tank pressure exceeds said reference pressure said controller actuates said valve means to vent said tank, and when said reference pressure and tank pressure are the same said controller actuates said valve to block said pressure transfer means as aforesaid.

14. A precision material filling system as set forth in claim 13 further including volumetric flow control means operatively coupled to said pressure transfer means and effective to selectably control the flow rate of pressurizing medium in at least one direction with respect to said dispensing tank.

15. A precision material filling system as set forth in claims 3 or 4 wherein said pressurizing means comprises transfer means including bi-directional pneumatic flow control means connecting a source of pneumatic pressure to said dispensing tank, and wherein the pressure on the product in said pressurized dispensable product supply source is higher than the pressure exerted by said pressurizing means on the product in said dispensing tank, whereby, when said product flow control means is actuated in said first way product flows from said supply source to said dispensing tank and said pneumatic flow control means vents pneumatic pressurizing medium applied to the product in said dispensing tank to maintain the product pressure at said dispensing means substantially constant.

16. A precision material filling system as set forth in claims 1 or 10 wherein said control means for actuating said timer means is manually operated means effective for each single manual operation to actuate said timer means once.

17. A precision material filling system as set forth in claim 16 wherein said dispensing means further includes, (a) counter means operatively coupled to said actuatable product dispenser, said counter means being effective when activated to register a count once during each time interval said product dispenser is actuated to dispense product, and being effective after registration of a pre-selectable count to prevent said timer means from further actuating said product dispenser in said first way, and (b) means for activating and deactivating said counter means.

18. A precision material filling system as set forth in claims 1 or 10 wherein said control means for actuating said timer means is a cyclically operating means effective when activated to continuously cyclically actuate said timer means, the cyclic rate of said cyclically operating means being selectable within limits.

19. A precision material filling system system as set forth in claim 3 wherein said pressurizing means comprises, (a) pressure monitoring means effective to monitor the pressure at a selected level in said tank, (b) pressure transfer means for coupling a source of a gaseous pressurizing medium to said tank, (c) control means operatively associated with said pressure transfer means and said pressure monitoring means, said control means being effective to cause the transfer of pressurizing medium to said tank when said pressure monitoring means senses a pressure less than a predetermined reference pressure, and being effective to cause the venting of pressurizing medium from said tank when said pressure monitoring means senses a pressure greater than the aforesaid predetermined reference pressure.

20. A precision material filling system as set forth in claim 3 or 19 wherein said dispensing tank contains a head space above the product in the tank, wherein said transfer means couples the pressurizing medium to the head space in said tank, and wherein said pressure monitoring means monitors the pressure in the tank headspace.

21. A precision material filling system as set forth in claim 20 wherein said pressure monitoring means and said control means are combined in a single precision pressure regulator device.

22. A precision material filling system as set forth in claim 20 wherein the gravity head pressure differential of the product in said dispensing tank between the said predetermined maximum and minimum product quantities in said tank is very small by comparison with the pressure exerted on the product in said dispensing tank by said pressurizing means.

23. A precision material filling system as set forth in claim 19 wherein said pressure monitoring means monitors the product pressure at a selected level in said tank below the free surface of the product.

24. A precision material filling system as set forth in claim 19 wherein said pressure monitoring means monitors the product pressure at the level in said tank where said dispensing means exits from said tank.

25. A precision material filling system as set forth in claims 2 or 19 further including volumetric flow control means operatively coupled to said pressure transfer means and effective to selectably control the flow rate of pressurizing medium in at least one direction with respect to said dispensing tank.

26. A precision material filling system characterized by, (a) a dispensing tank containing a flowable dispensable product, (b) dispensing means associated with the dispensing tank for dispensing product from said tank, (c) pressurizing means operatively coupled to said dispensing tank effective for pneumatically pressurizing the product in said tank, said pressurizing means being effective to maintain the product pressure at said dispensing means substantially constant irrespective of the product quantity in said dispensing tank, said pressurizing means comprising, (1) pressure monitoring means effective to monitor the pressure in said tank below the free surface of said product, (2) pressure transfer means for coupling a source of a gaseous pressurizing medium to said tank, (3) control means operatively associated with said pressure transfer means and said pressure monitoring means, said control means being effective to cause the transfer of pressurizing medium to said tank when said pressure monitoring means senses a pressure less than a predetermined reference pressure, and being effective to cause the venting of pressurizing medium from said tank when said pressure monitoring means senses a pressure greater than the aforesaid predetermined reference pressure.

27. A precision material filling system characterized by, (a) a dispensing tank containing a flowable dispensable product, (b) dispensing means associated with the dispensing tank for dispensing product from said tank, (c) pressurizing means operatively coupled to said dispensing tank effective for pneumatically pressurizing the product in said tank, said pressurizing means being effective to maintain the product pressure at said dispensing means substantially constant irrespective of the product quantity in said dispensing tank, said pressurizing means comprising, (1) pressure monitoring means effective to monitor the pressure in said tank where said dispensing means exits from said tank, (2) pressure transfer means for coupling a source of a gaseous pressurizing medium to said tank, (3) control means operatively associated with said pressure transfer means and said pressure monitoring means, said control means being effective to cause the transfer of pressurizing medium to said tank when said pressure monitoring means senses a pressure less than a predetermined reference pressure, and being effective to cause the venting of pressurizing medium from said tank when said pressure monitoring means senses a pressure greater than the aforesaid predetermined reference pressure.

28. A precision material filling system as set forth in claims 23, 24, 26 or 27 wherein said control means comprises (a) pressure differential sensing controller means, (b) valve means actuatable by said pressure differential sensing controller means for pressurizing said tank by connecting said tank through said pressure transfer means to said source of pressurizing medium, actuatable for venting said tank, and actuatable for blocking said pressure transfer means to neither pressurize nor vent said tank, and (c) reference pressure setting means operatively coupling a reference pressure to said pressure differential sensing controller means derived from the source of pressurizing medium, said pressure monitoring means also coupling the pressure monitored at said tank to said pressure differential sensing controller means, whereby, when said reference pressure exceeds said tank pressure said controller actuates said valve means to pressurize said tank, when said tank pressure exceeds said reference pressure said controller actuates said valve means to vent said tank, and when said reference pressure and tank pressure are the same said controller actuates said valve to block said pressure transfer means as aforesaid.

* * * * *